US011655136B2

(12) United States Patent
Szeteli

(10) Patent No.: US 11,655,136 B2
(45) Date of Patent: May 23, 2023

(54) WITHDRAWAL SYSTEM

(71) Applicant: AS Strömungstechnik GmbH, Ostfildern (DE)

(72) Inventor: Andreas Szeteli, Filderstadt (DE)

(73) Assignee: AS Strömungstechnik GmbH, Ostfildern (DE)

( * ) Notice: Subject to any disclaimer, the term of this patent is extended or adjusted under 35 U.S.C. 154(b) by 111 days.

(21) Appl. No.: 17/367,318

(22) Filed: Jul. 3, 2021

(65) Prior Publication Data

US 2022/0401980 A1 Dec. 22, 2022

(30) Foreign Application Priority Data

Jun. 22, 2021 (DE) ..... 102021116140.1

(51) Int. Cl.

| | |
|---|---|
| ***B67D 7/34*** | (2010.01) |
| ***B05B 11/00*** | (2023.01) |
| ***B05B 15/30*** | (2018.01) |
| ***B05B 12/08*** | (2006.01) |

(52) U.S. Cl.

CPC ..... *B05B 11/0008* (2013.01); *B05B 12/08* (2013.01); *B05B 15/30* (2018.02); *B67D 7/344* (2013.01)

(58) Field of Classification Search

CPC ..... B67D 7/344; B05B 15/30

See application file for complete search history.

(56) References Cited

U.S. PATENT DOCUMENTS 6,357,494 B1 * 3/2002 Hahn ..... B67D 7/344 141/378
9,580,197 B2 * 2/2017 Szeteli ..... B65B 69/0075
9,828,232 B2 * 11/2017 Szeteli ..... B67D 7/221

FOREIGN PATENT DOCUMENTS

EP 0977702 B1 4/1998

* cited by examiner

*Primary Examiner* — Jason K Niesz
(74) *Attorney, Agent, or Firm* — Michael Soderman

(57) ABSTRACT

A removal system (1) for a container designed to receive a fluid, with an extraction head (4) and a dip tube (5) that can be fastened thereto. By means of the extraction head (4), fluid can be removed through the dip tube (5) from the container (3) or fluid can be fed into the container (3). The extraction head (4) can be fastened to the dip tube (5) by a displacement movement. Alternatively or additionally, a target position of the dip tube (5) at the extraction head (4) is monitored by means of an optical sensor (12).

13 Claims, 3 Drawing Sheets

WITHDRAWAL SYSTEM

CROSS REFERENCE TO RELATED APPLICATIONS

This application claims the priority of DE 102021116140.1 filed on 2021 Jun. 22; this application is incorporated by reference herein in its entirety.

BACKGROUND

The invention relates to a removal system according to the preamble of claim 1.

Such a removal system is known from EP 0 977 702 B1. This removal system serves the purpose of filling and emptying containers, especially barrels, filled with fluid chemicals. The removal system comprises a container closure. This container closure is generally inserted into a container opening that receives a bung head. The container closure itself has a dip tube that can be connected to the bung head via which dip tube fluids stored in the container can be removed and via which dip tube fluids can be fed into the container. Furthermore, the container closure has an extraction connection element that is typically designed in the form of an extraction head and which can be connected to the bung head.

Fluid is then removed from, or as the case may be, fed into, the container via the extraction connection element. To do so, a pump is connected via the extraction connection element in order to effect the removal or supply of fluid.

The fluids stored in the containers are typically specialized chemicals in fluid form.

On the one hand, these specialized chemicals require a high degree of purity, i.e., contaminants must be kept away from these chemicals. Furthermore, these specialized chemicals can be hazardous substances, such that uncontrolled escaping of fluid must be prevented already for this reason alone.

SUMMARY

Upon this basis, the invention seeks to solve the problem of providing a removal system that enables safe and hazard-free removal of fluids from a container. Filling of containers can equally be performed with the removal system.

The features of claim 1 are provided to solve this problem. Advantageous embodiments and useful further developments of the invention are described in the dependent claims.

The invention relates to a removal system for a container that is designed to receive a fluid, with an extraction head and a dip tube that can be attached to the extraction head. Fluid can be removed from the container or fluid can be supplied to the container via the dip tube by means of the extraction head. The extraction head can be fixed in place by a displacement movement at the dip tube. Alternatively or additionally, a target position of the dip tube at the extraction head is monitored by means of an optical sensor.

DETAILED DESCRIPTION

An essential aspect of the invention is that solely by a displacement movement of the extraction head relative to the dip tube, these two units can be connected to one another, whereby the connection can be designed, in particular, as a form-locked or force-locked connection.

The connection between the dip tube and extraction head can therefore be created quickly and easily. In particular, the connection can be established autonomously in an automatic process, i.e. without manual intervention of operating personnel. Especially advantageously, the connection is established by means of a robot.

Another essential aspect of the invention is that by means of the optical sensor, it is autonomously checked whether the extraction head is correctly fastened to the dip tube or not. This makes it possible to prevent an uncontrolled escape of fluids from the container since based on the output signals of the optical sensor, it can be immediately detected whether the extraction head and the dip tube are correctly connected. This enables any leakage points between the extraction head and dip tube as a result of inadequate fastening between these units to be detected and countermeasures to be introduced in a timely manner.

If a fault-free connection between extraction head and dip tube is reported by the output signals of the optical sensor, fluid can be removed from or supplied to the container.

According to an advantageous embodiment, the output signals of the optical sensor are read into a control unit and depending on the output signals of the optical sensor, the removal or filling of the container is released or blocked by means of the control unit.

Expediently, the control unit controls a pump by means of which fluid can be removed from the container or filled into it. The operation of the pump is only released via the control unit if fault-free fastening of the extraction head at the dip tube is reported by the optical sensor.

In this manner, a fully automated safety function is realized for the removal system according to the invention.

The functionality of this safety system can be additionally expanded in that the output signals of the optical sensor are fed into a warning signal generator that generates a warning signal when the switch is not actuated.

In this manner, users of the removal system are notified of fault conditions with regard to the fastening between the extraction head and dip tube, such that the respective user can take countermeasures immediately. The warning signal generator can be in the form of a horn, for example, that emits an acoustic warning signal. Alternatively, the warning signal generator can be in the form of a lamp that emits an optical warning signal.

The monitoring function of the optical sensor supports a fastening of the extraction head to the dip tube performed autonomously with a robot since the output signals of the optical sensor make it possible to check the fastening status of the extraction head at the dip tube, such that the robot can perform the fastening depending on the output signals of the optical sensor.

It is advantageous for the optical sensor to generate the output signals in the form of binary switching signals, the switching states of which indicate the absence or presence of an object.

According to an advantageous embodiment, the optical sensor is a light barrier.

The light barrier can be designed in the form of a one-way light barrier or a reflection light barrier. Objects are generally detected by detecting an interruption in a light beam emitted by a transmitter of the light barrier. If no object is present, the light beams of the transmitter fall on the receiver of the light barrier unhindered.

According to an embodiment with an advantageous design, the optical sensor is a fork light barrier.

According to an advantageous embodiment, a positioning element is moved by the displacement movement of the extraction head relative to the dip tube, wherein the position of the positioning element is controlled by means of the optical sensor.

The optical sensor then generates a binary switching signal, the switching states of which indicate whether the positioning element is in the detection range of the optical sensor or not.

The positioning element only projects into the detection range of the optical sensor when the extraction head is located in the region of the target position at the dip tube.

In this manner, it can be easily and reliably checked whether the extraction head is correctly connected to the dip tube.

In general, various forms of movement are possible for the positioning elements.

A displacement movement of the positioning element is effected, in particular, by the displacement movement of the extraction head relative to the dip tube.

It is especially expedient for the positioning element to be designed in the form of a pin that is displaceably located in a borehole of the extraction head.

In this embodiment, the pin projects, in a starting position, beyond a lower edge of the extraction head and is outside the detection range of the optical sensor. By contact with the dip tube, the pin can be displaced to an end position in which the upper end of the pin lies within the detection range of the optical sensor.

The starting position and the end position of the pin therefore form two states unambiguously distinguishable with the optical sensor, by which means the optical sensor can reliably detect whether the extraction head is correctly connected to the dip tube, which is only the case when the pin is located in its end position.

It is especially advantageous for the housing segment of the extraction head to be designed as a hollow cylinder, wherein a connection segment of the extraction head projects beyond the open bottom side of said housing segment, which connection segment is designed for connection to the dip tube.

The dip tube can be slid onto the connection segment.

The dip tube is fastened by sliding the dip tube onto the connection segment, wherein it is advantageous for a form-locked or force-locked connection to result between the connection segment and the dip tube. For this purpose, the inner diameter and the inner wall of the dip tube are adapted to the outer diameter and outer wall of the dip tube.

It is especially advantageous for the lower edge of the housing segment to form a stop for the dip tube, wherein the pin in its starting position projects beyond the lower edge of the housing segment.

The stop defines the target position of the dip tube for fastening to the extraction head. If the upper edge of the dip tube abuts the stop, the dip tube is correctly fastened to the extraction head.

This correct fastening is reliably verified by means of the optical sensor in that the upper edge of the dip tube, when the latter is slid onto the connection segment, pushes the pin into the borehole. Once the upper edge of the dip tube is moved against the stop, the pin is fully inserted into the borehole, such that the upper part of the pin lies in the detection range of the optical sensor and is therefore reliably detected by the latter.

Advantageously, the switching signal of the optical sensor then causes an optical signal generator integrated at the extraction head to illuminate when the switch is actuated.

Preferably the signal generator is in the form of a light-emitting diode. With the signal generator, it is immediately signalized to the user whether the extraction head is correctly fastened at the dip tube.

BRIEF DESCRIPTION OF THE DRAWINGS

The invention is explained below based on the drawings. They show.

DETAILED DESCRIPTION OF THE PREFERRED EMBODIMENTS

Figure 1:
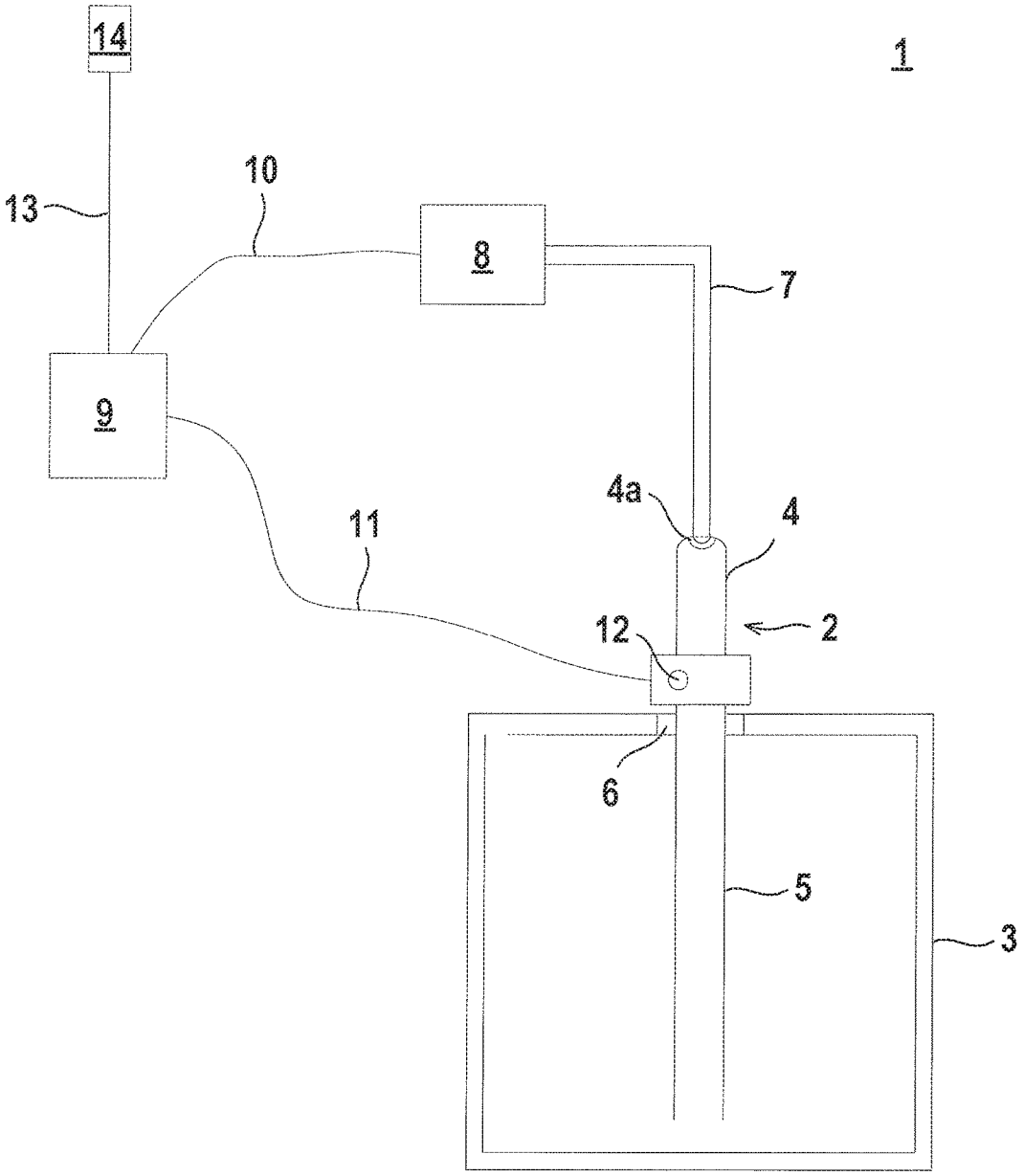
FIG. 1: Schematic depiction of the removal system according to the invention.

FIG. 1 shows in schematic form an exemplary embodiment of the extraction system 1 according to the invention. The removal system 1 comprises a container closure 2 for a transportable container 3, which is in the form of a barrel or similar, in particular. A fluid is stored in the container 3. Fluids stored in such containers 3 are specialized chemicals in fluid form, in particular.

The container closure 2 comprises an extraction head 4 and a dip tube 5. The dip tube 5 is mounted in a bung head 6, which sits in a container opening of the container 3 and is thus securely connected to the container 3. The longitudinal axis of the dip tube 5 runs in the vertical direction. The components of the container closure 2 are composed of chemically resistant plastics such that they are not weakened by the specialized chemicals stored in the container 3. The container closure 2 usually also serves as a closure of the container 3 during its transport.

The extraction head 4 serves to remove fluids from the container 3. The extraction head 4 can also be used to fill containers 3. For this purpose, the extraction head 4 has a fluid connection 4*a* at its upper end. A line 7, which leads to a pump 8, is connected to this fluid connection 4*a*. The line 7 can be in the form of a tube.

The pump 8 is controlled by a control unit 9. For this purpose, the pump 8 is connected to the control unit 9 via a cable 10.

The extraction head 4 can be fastened to the dip tube 5. The fastening can be performed by means of a robot. It is autonomously detected by means of an optical sensor 12 whether the extraction head 4 is fastened correctly and in a target position at the dip tube 5. In the present case, the optical sensor 12 is in the form of a fork light barrier. The optical sensor 12 generates an output signal in the form of a binary switching signal, the switching states of which indicate whether an object is located within the detection range of the optical sensor 12 or not. The switching signal generated in the optical sensor 12 is read into the control unit 9, wherein for this purpose the optical sensor 12 is connected to the control unit 9 via a cable 11. The control unit 9 controls the pump 8 depending on the switching signal generated by the optical sensor 12. Operation of the pump 8 is only released by the control unit 9 when the optical sensor 12 reports fault-free fastening of the extraction head 4 at the dip tube 5. In this manner, hazardous conditions of the kind where, in the event of incorrect fastening of the extraction head 4, a fluid removal from the container 3 or a fluid supply to the latter occurs and fluid may escape are prevented.

Finally, a warning signal generator 14 is connected to the control unit 9 via an additional cable 13. The generator generates a warning signal when an incorrect fastening is reported by the switching signal of the optical sensor 12. The warning signal generator 14 can be provided in the form of a horn or a lamp.

Figure 2:
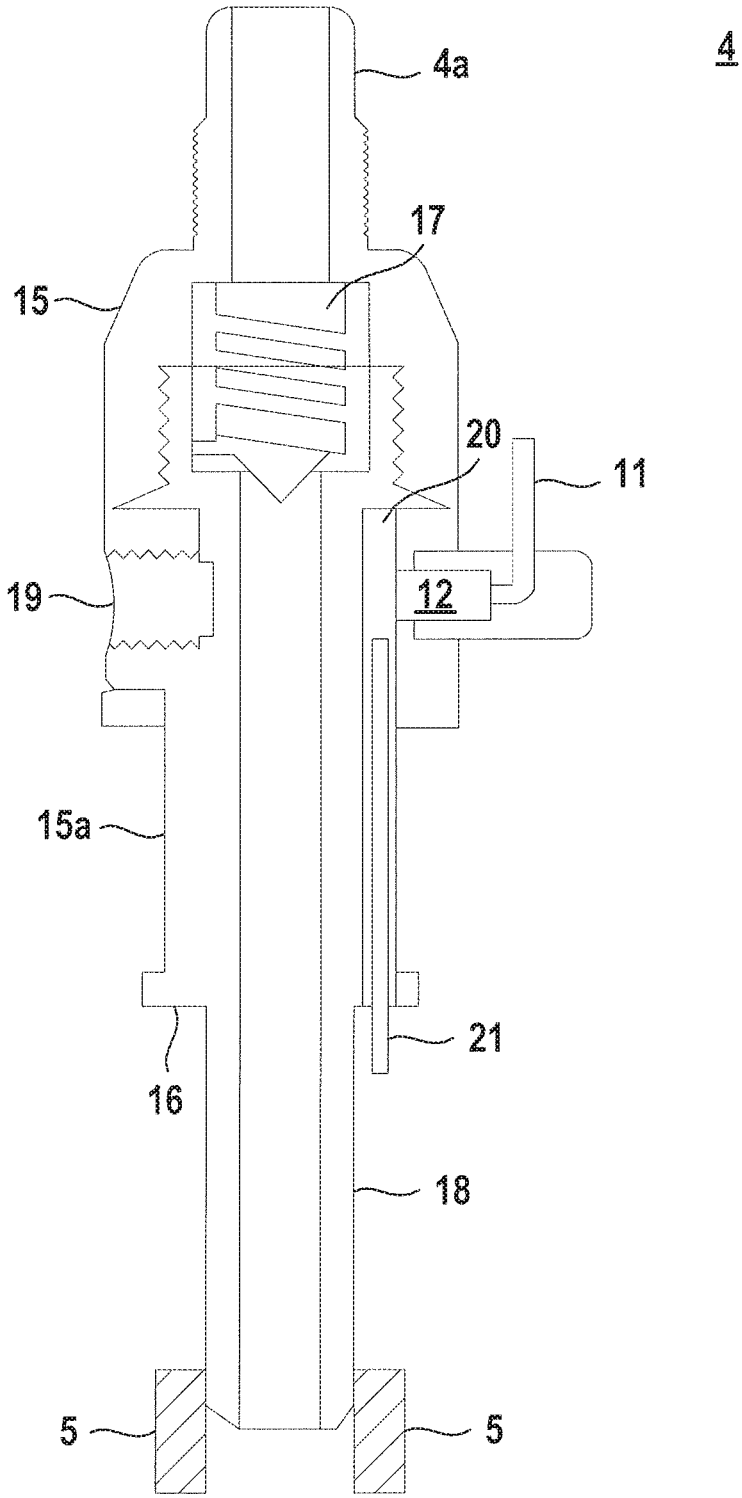
FIG. 2: Depiction of the extraction head of the removal system according to FIG. 1, wherein the dip tube is not engaged with the extraction head.
Figure 3:
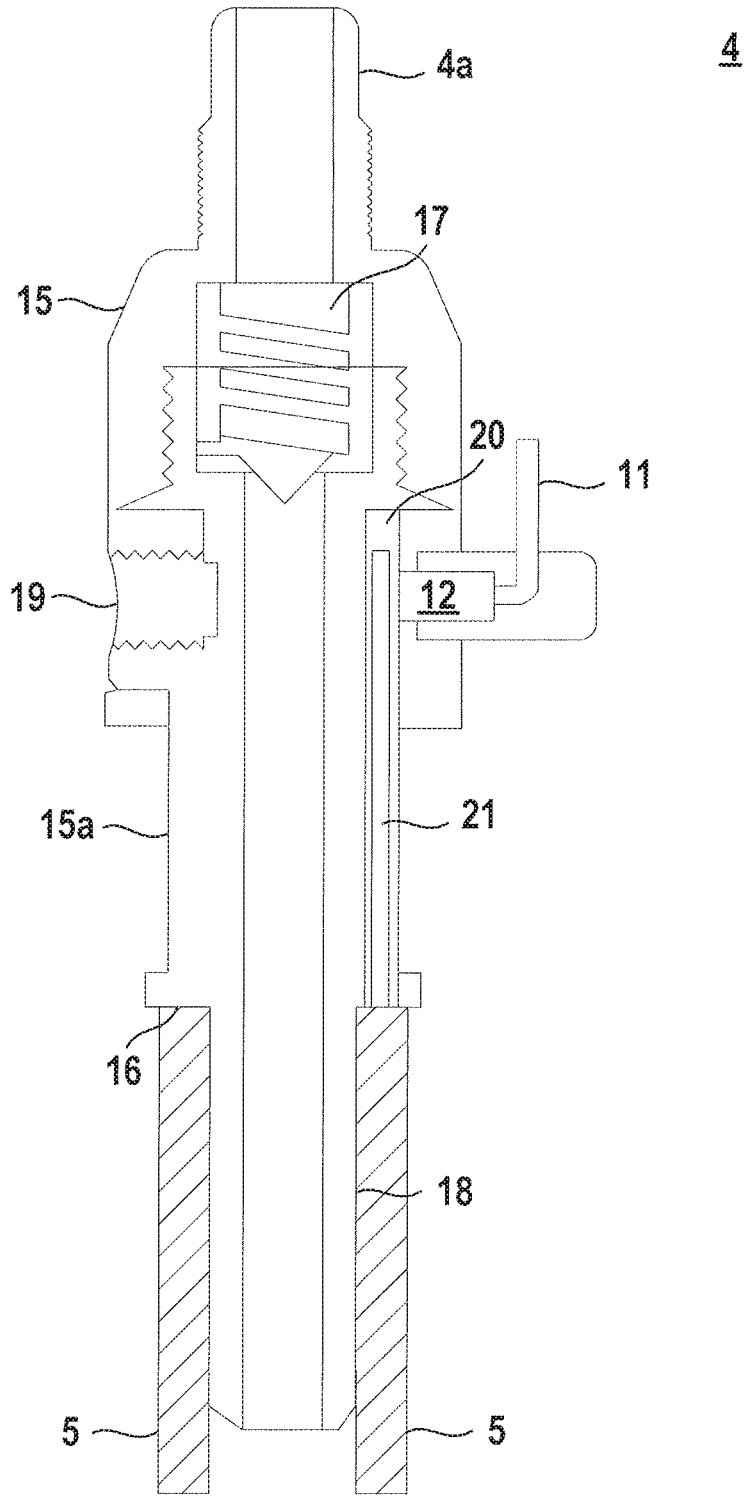
FIG. 3: Arrangement from FIG. 2 with dip tube fastened at the extraction head.

FIGS. 2 and 3 show a detail depiction of the extraction head 4 from FIG. 1. FIG. 2 shows an arrangement in which the dip tube 5 is not in engagement with the extraction head 4. FIG. 3 shows the dip tube 5 fastened to the extraction head 4.

The extraction head 4 has a housing 15 wherein the lower part of the housing 15 is formed by a hollow cylindrical housing segment 15*a*, the bottom side of which is open. The lower edge of the housing segment 15*a* forms a stop for positioning the upper edge of the dip tube 5 against.

The fluid connection 4*a* opens out at an opening on the top side of the housing 15. The fluid connection 4*a* runs in the axial direction of the housing 15. The vertical longitudinal axis of the fluid connection 4*a* runs along the axis of symmetry. A check valve 17, which prevents uncontrolled return flow of fluid in the direction of container 3, is connected to the bottom side of the fluid connection 4*a*.

A connection segment 18 running in the axial direction of the housing 15 connects to the bottom side of the check valve 17 as an additional component of the extraction head 4. The upper part of the connection segment 18 runs in the housing segment 15*a*; the lower part of the connection segment 18 projects downwards beyond the open lower side of the housing segment 15*a*.

Both the fluid connection 4*a* as well as the connection segment 18 form hollow cylindrical bodies in the inner cavities of which fluid can be transported out of the container 3.

A threaded connection 19 opens out sideways from the housing 15. The former serves to connect a line 7 through which pressure equalization and ventilation of the container 3 is possible.

The optical sensor 12 in the form of a fork light barrier is arranged in a side wall of the housing 15. The optical sensor 12 is arranged to the side of a borehole 20 which runs parallel to the longitudinal axis of the housing 15 and which opens out at the lower edge of the housing segment 15*a*. In the borehole 20 running along a straight line, a pin 21 is introduced as a positioning element, the longitudinal axis of which also runs along a straight line and which is displaceably arranged in the borehole 20 with little play.

FIG. 2 shows the pin 21 in its starting position, in which the lower end of the pin 21 projects downwards out of the borehole 20. The starting position can be secured by suitable positioning means, such as a return spring.

The optical sensor 12 is positioned relative to the borehole 20 such that the pin 21 in its starting position lies outside the detection range.

FIG. 3 shows the pin 21 in its end position, in which the pin 21 is completely inserted into the borehole 20. In this case, the upper part of the pin 21 projects into the detection range of the optical sensor 12, such that the latter detects the pin 21.

The switching states of the switching signal of the optical sensor 12 therefore indicate whether the pin 21 is located in the detection range or not, i.e. the optical sensor 12 detects whether the pin 21 is in the starting position or in the end position.

FIG. 2 shows the extraction head 4 when the dip tube 5 is not yet fastened to the connection segment 18. The pin 21 is then in the starting position.

For fastening the extraction head 4 to the dip tube, the connection segment 18 is pushed into the inner cavity of the dip tube 5 until the upper edge of the dip tube 5 abuts the stop 16. The connection segment 18 is then borne in the dip tube by form-locking or force-locking and thus is securely fastened to the extraction head 4.

By positioning the upper edge of the dip tube 5 at the stop 16, the pin 21 is pushed from its starting position to its end position. The pin 21 is then located in the detection range of the optical sensor, which then generates a switching signal by which means a correct fastening of the extraction head 4 on the dip tube 5 is reported.

LIST OF REFERENCE NUMERALS (1) removal system
(2) container closure
(3) container
(4) extraction head
(4*a*) fluid connection
(5) dip tube
(6) bung head
(7) line
(8) pump
(9) control unit
(10) cable
(11) cable
(12) optical sensor
(13) cable
(14) warning signal generator
(15) housing
(15*a*) housing segment
(16) stop
(17) check valve
(18) connection segment
(19) threaded connection
(20) borehole
(21) pin

The invention claimed is:

1. A removal system (1) for a container designed for receiving a fluid, with an extraction head (4) and a dip tube (5) that can be fastened thereto, wherein by means of the extraction head (4) fluid can be removed through the dip tube (5) from the container (3) or fluid can be fed into the container (3), characterized in that the extraction head (4) can be fastened to the dip tube (5) by a displacement movement, and/or that a target position of the dip tube (5) at the extraction head (4) is monitored by an optical sensor (12), wherein, due to the displacement movement of the extraction head (4) relative to the displacement tube (5), a positioning element is moved, wherein the position of the positioning element is monitored by the optical sensor (12), and wherein the optical sensor (12) generates a binary switching signal, the switching states of which indicate whether the positioning element is located in the detection range of the optical sensor (12) or not.

2. The removal system (1) according to claim 1, characterized in that the positioning element only projects into the detection range of the optical sensor (12) when the extraction head (4) is located in the region of the target position at the dip tube (5).

3. The removal system (1) according to claim 1, characterized in that a displacement movement of the positioning element is effected by the displacement movement of the extraction head (4) relative to the dip tube (5).

4. The removal system (1) according to claim 1, characterized in that the extraction head (4) can be connected to the dip tube (5) by means of a robot.

5. The removal system (1) according to claim 1, characterized in that the optical sensor (12) is a light barrier.

6. The removal system (1) according to claim 5, characterized in that the optical sensor (12) is a fork light barrier.

7. The removal system (1) according to claim 1, characterized in that the positioning element is designed in the form of a pin (21), which is displaceably located in a borehole (20) of the extraction head (4).

8. The removal system (1) according to claim 7, characterized in that the pin (21) in a starting position projects beyond a lower edge of the extraction head (4) and is outside the detection range of the optical sensor (12), and that by contact with the dip tube (5), the pin (21) is displaceable into an end position, in which the upper end of the pin (21) lies in the detection range of the optical sensor (12).

9. The removal system (1) according to claim 7, characterized in that a housing segment (15*a*) of the extraction head (4) is in the shape of a hollow cylinder, whereby a connection segment (18) of the extraction head (4) projects beyond the open bottom side of the housing segment (15*a*), the connection segment (18) being designed for connecting the dip tube (5).

10. The removal system (1) according to claim 9, characterized in that the dip tube (5) can be pushed onto the connection segment (18).

11. The removal system (1) according to claim 9, characterized in that the lower edge of the housing segment (15*a*) forms a stop (16) for the dip tube (5), wherein the pin (21) in its starting position projects beyond the lower edge of the housing segment (15*a*).

12. The removal system (1) according to claim 11, characterized in that with the dip tube (5) abutting the stop (16), the pin (21) is pushed into the borehole (20) and lies in the end position.

13. The removal system (1) according to claim 11, characterized in that the dip tube (5) abutting the stop (16) is secured in place by a form-locked or force-locked connection with the connection segment (18).

* * * * *